US009566458B2

(12) United States Patent
Duvekot et al.

(10) Patent No.: US 9,566,458 B2
(45) Date of Patent: Feb. 14, 2017

(54) MOUNTING DEVICE AND FALL PROTECTION SYSTEM

(75) Inventors: Joost Cornelis Duvekot, The Hague (NL); Martin Mastenbroek, Bussum (NL)

(73) Assignee: KEDGE HOLDING B.V., Gorinchem (NL)

( * ) Notice: Subject to any disclaimer, the term of this patent is extended or adjusted under 35 U.S.C. 154(b) by 1326 days.

(21) Appl. No.: 12/993,356

(22) PCT Filed: Mar. 27, 2009

(86) PCT No.: PCT/NL2009/050155

§ 371 (c)(1),
(2), (4) Date: Dec. 13, 2010

(87) PCT Pub. No.: WO2009/142480

PCT Pub. Date: Nov. 26, 2009

(65) Prior Publication Data

US 2011/0094828 A1 Apr. 28, 2011

(30) Foreign Application Priority Data

May 19, 2008 (NL) ..... 2001595

(51) Int. Cl.

| | |
|---|---|
| ***A62B 1/04*** | (2006.01) |
| ***A62B 35/00*** | (2006.01) |
| *E04G 21/32* | (2006.01) |

(52) U.S. Cl.

CPC ..... *A62B 1/04* (2013.01); *A62B 35/0068* (2013.01); *E04G 21/3261* (2013.01)

(58) Field of Classification Search

CPC ..... A62B 35/0068; A62B 1/04; E01F 9/658
USPC ..... 182/3; 248/499; 40/607.1, 607.05, 610
See application file for complete search history.

(56) References Cited

U.S. PATENT DOCUMENTS

| | | | | | |
|---|---|---|---|---|---|
| 2,143,783 | A | * | 1/1939 | Liebman | 182/110 |
| 2,303,393 | A | * | 12/1942 | Schmidt | 294/186 |
| 2,886,277 | A | * | 5/1959 | Boham et al. | 248/205.5 |
| 4,185,421 | A | * | 1/1980 | Robinson | 52/11 |
| 5,456,443 | A | * | 10/1995 | Taaffe | 248/551 |
| 5,676,085 | A | * | 10/1997 | Michl, Jr. | 114/230.1 |
| 5,699,875 | A | * | 12/1997 | Dugan | 182/3 |
| 5,755,528 | A | * | 5/1998 | Kulp | E01F 9/688 116/63 P |

(Continued)

FOREIGN PATENT DOCUMENTS

| | | |
|---|---|---|
| EP | 1690567 A2 | 8/2006 |
| EP | 1698747 A2 | 9/2006 |

(Continued)

*Primary Examiner* — Colleen M Chavchavadze
(74) *Attorney, Agent, or Firm* — Birch, Stewart, Kolasch & Birch, LLP

(57) ABSTRACT

A mounting device for mounting on a wall of an object comprises an at least substantially form-retaining base part (20) with at least one mounting member (10) and a substantially flexible flap (30), a distal part (32) of which extends substantially freely and laterally from the base part (20) and which is intended and adapted to be connected firmly to a surface of the wall of the object. The base part (20) comprises a form-retaining body which is formed integrally with a solid monolithic core, wherein a proximal part (31) of the flap (30) is incorporated at least substantially tightly in the core material of the body.

12 Claims, 2 Drawing Sheets

(56) References Cited

U.S. PATENT DOCUMENTS

| | | | | |
|---|---|---|---|---|
| 5,839,532 | A * | 11/1998 | Yoshiji et al. | 180/164 |
| 5,865,583 | A * | 2/1999 | Krawczak et al. | 411/369 |
| 5,894,705 | A * | 4/1999 | Sutton | 52/747.1 |
| 5,909,758 | A * | 6/1999 | Kitamura | 16/406 |
| 6,547,033 | B1 * | 4/2003 | Cheval | 182/3 |
| 6,607,054 | B1 * | 8/2003 | Lindfield | 182/113 |
| 6,745,868 | B2 * | 6/2004 | Cheval | 182/3 |
| 6,779,316 | B2 * | 8/2004 | Carroll | 52/698 |
| 6,868,647 | B2 * | 3/2005 | Poldmaa | 52/749.12 |
| 7,207,414 | B2 * | 4/2007 | Luke et al. | 182/3 |
| 7,914,057 | B2 * | 3/2011 | Rohlf | 248/363 |
| 8,025,125 | B2 * | 9/2011 | Vetesnik et al. | 182/45 |
| 8,104,809 | B1 * | 1/2012 | Mayhugh | 294/187 |
| 9,316,008 | B2 * | 4/2016 | Poldmaa | A62B 1/04 |
| 2003/0150672 | A1 * | 8/2003 | Cheval | 182/3 |
| 2006/0273600 | A1 * | 12/2006 | Rohlf | 294/64.1 |
| 2007/0144830 | A1 * | 6/2007 | Mastenbroek | 182/3 |
| 2007/0187965 | A1 * | 8/2007 | Schaaf et al. | 294/64.1 |

FOREIGN PATENT DOCUMENTS

| | | | | |
|---|---|---|---|---|
| EP | 1803871 | A2 | 7/2007 | |
| NL | EP 1690567 | A2 * | 8/2006 | A62B 1/04 |

* cited by examiner

MOUNTING DEVICE AND FALL PROTECTION SYSTEM

The present invention relates to a mounting device for mounting on an object, comprising an at least substantially form-retaining base part with at least one mounting member and comprising a substantially flexible flap which extends laterally relative to the base part with an at least substantially leak-tight, at least substantially free distal part, and which is intended and adapted to be attached to a surface of the object. The invention also relates to a fall protection system.

A mounting device of the type stated in the preamble is known from European patent EP 1.699.991 of applicant. The mounting device described therein forms part of a safety device to which a person can for instance secure him/herself during work with falling hazard. In an embodiment of the known mounting device the base part comprises a high-quality assembly of a set of dish-like metal flange bodies between which the proximal part of the flexible flap is received. The different parts are clamped firmly and tightly onto each other under the influence of a clamping force produced by a central bolt, from which a fastening member in the form of a fixing eyelet extends at a distal outer end. The flexible flap comprises a piece of wall-covering material, in particular of a bituminous roof-covering material, and a distal portion thereof extends in the order of about 25 centimeters outside the flange bodies. The flexible flap hereby provides a reliable fixing basis with which the whole can be attached in conventional leak-tight manner to an existing wall-covering of for instance a building. The tight clamping of the proximal part of the flap between the two flange bodies herein ensures not only a reliable anchoring of the flap, but also the desired leak-tightness of the whole.

Although the known mounting device per se enables an exceptionally reliable, durable and robust attachment to a roof or other wall of a building, the high-quality construction thereof does however have the drawback than the cost price is relatively high, the same being the case for the weight of the known device.

The present invention therefore has for its object, among others, to provide a mounting device which, while retaining quality and reliability, can be manufactured in lighter form and more economically.

In order to achieve the stated object a mounting device of the type stated in the preamble has the feature that the base part comprises an at least substantially integrally formed, form-retaining body with an at least substantially solid core, and that a proximal part of the flexible flap is incorporated at least substantially tightly in the core of the body and the distal part of the flexible flap extends laterally from the base part. A desired leak-tightness between the base part and the flexible flap is achieved here in that the proximal part of the flap, fully enclosed by core material of the body, is integrated therein. A relatively heavy clamping construction as in the known device can thus be dispensed with. The structure according to the invention moreover allows relatively low production costs and a relatively light weight of the whole.

A preferred embodiment of the mounting device according to the invention has in this respect the feature that the body comprises a core material which is cast around the proximal part of the flap, and more particularly that the core material comprises a thermoplastic plastic and is arranged at increased temperature on either side of the proximal part of the flap in a thermoforming process. Such a casting or other embedding of the proximal part of the flexible flap already results per se in an exceptionally reliable, durable and strong attachment and anchoring of the flap in the body, while a manufacturing process of the whole is also very simple.

For an adequate anchoring of the proximal part of the flap in the body, even in the case of an extremely high pull load, a further embodiment of the mounting device according to the invention has the feature that the proximal part of the flap has an open structure for the purpose of receiving core material of the body between a first and second main surface of the flap. The open structure of the proximal part of the flap thus allows material of the body, for instance during a casting process, to penetrate therein from both sides, whereby after curing of the body the flap is fixed firmly in the body. The open structure can here be realized, among other methods, by making full or partial use of an open net structure for the flap or by arranging perforations, channels or an otherwise open grid locally in a closed flap.

For optimum compatibility with an existing wall-covering, a further preferred embodiment of the mounting device according to the invention has the feature that the flap comprises a wall-covering material, in particular a bituminous or plastic roof-covering material. The flap can thus be attached to an existing roof or wall-covering making use of conventional surface attachment techniques such as welding, burning or glueing, without adversely affecting the integrity of the existing covering.

A particularly compact embodiment of the mounting device according to the invention has the feature that the body and the flexible flap comprise substantially concentric or circular peripheries. The invention is here based on the insight that an attachment force of the flap to a surface will be proportional to a size of the attachment surface, and that a circular periphery, given this surface, requires a minimum of space. Exceptionally good results have been achieved in this respect with a practical embodiment of the mounting device according to the invention which is characterized in that the body has a diameter lying between 15 and 25 centimeters and that a substantially free distal part of the flap extends at least 20-30 centimeters outside the body. It has been found that such dimensions can bring about an attachment of the flap to an existing roof-covering which is sufficient under normal conditions to absorb for instance a dynamic load as can occur when the mounting device is applied in a fall protection system for securing a person in the case of falling hazard. An anchoring of the proximal part of the flap in the base part for the purpose of such an application is found in practice to be sufficient in a further particular embodiment of the mounting device according to the invention characterized in that the proximal part of the flap protrudes at least 10 centimeters into the body.

For the purpose of applying the mounting device in more extreme conditions, such as for instance in exceptional climatological conditions or under an extreme pull load, a further particular embodiment of the mounting device according to the invention has the feature that on a side of the flap remote from the mounting member a flange part extends laterally from the body with an outer edge lying between a corresponding outer edge of a part of the body lying on an opposite side of the flap and an outer edge of the flap. The flange part herein provides an additional mounting basis suitable for a mechanical, penetrating primary attachment of the device to a surface, while the flap extending thereover guarantees a leak-tight seal as well as a secondary, surface attachment of the whole to the surface of the object. It is possible here to opt for a primary attachment which is as strong as necessary for a specific application.

The flange part can comprise an optionally form-retaining, separate part which is assembled with another part of the device, although in a further preferred embodiment the mounting device according to the invention is characterized in that the flange part extends monolithically, i.e. as one whole, from the body. The flange part can thus be formed integrally with the other part of the base part.

The same applies to the mounting member. This can also be assembled separately with the other part of the device and be permanently fixed to the body, for instance by screws or in other mechanical manner. The mounting member, in the same way as the flexible flap, can here particularly be cast into the body or otherwise integrated therein during manufacture. However, a preferred embodiment of the mounting device according to the invention has the feature that the mounting member is formed monolithically, i.e. as one whole, with the body. No additional components or operations are thus required for the mounting member, and an extremely robust, leak-tight entity is created.

The present invention likewise relates to a fall protection system, comprising at least one mounting device according to the invention in a fall protection assembly which further comprises at least a personal fall protection means which is intended and adapted to be coupled directly or indirectly to a mounting member of the at least one mounting device.

The invention will be further elucidated hereinbelow on the basis of a number of exemplary embodiments and an accompanying drawing. In the drawing.

The figures are otherwise purely schematic and at least not always drawn to scale. Some dimensions in particular may be exaggerated to a greater or lesser extent for the sake of clarity. Corresponding parts are designated as far as possible in the figures with the same reference numeral.

Figure 1:
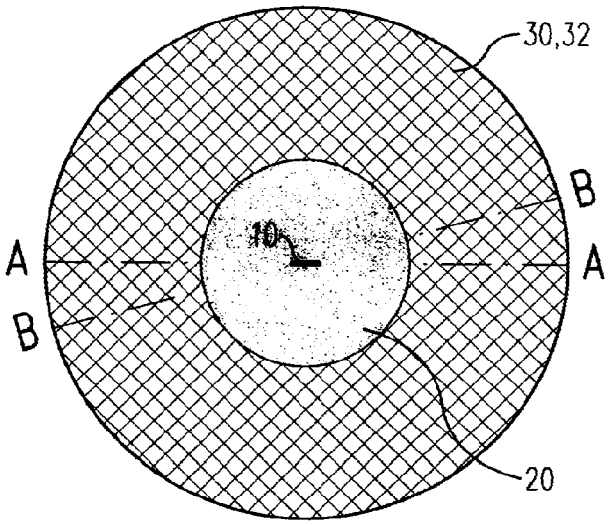
FIG. 1 shows a top view of a first exemplary embodiment of a mounting device according to the invention.
Figure 2A:
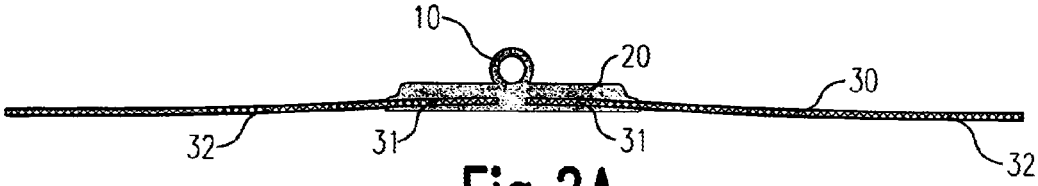
FIG. 2A shows a cross-section of the device of FIG. 1 along line A-A.

The mounting device of FIG. 1 can for instance be applied as anchoring base in a fall protection system, and comprises for this purpose a mounting member 10, in this example in the form of a form-fitting fixing eyelet, see also FIG. 2A, to which can be coupled, directly or indirectly, a safety line extending from a personal fall protection means, such as a fall-arrest harness or safety harness. Fixing eyelet 10 extends monolithically, i.e. in one whole, from a central base part of the device comprising an at least substantially form-retaining body 20 which is otherwise also formed integrally with a solid core. In this example base part 20 is cast wholly at increased temperature in a corresponding mould from a durable thermoplastic plastic, such as for instance polystyrene, polypropylene or ABS as core material, and subsequently cured to a form-retaining entity with a roughly circular outer periphery. A diameter of base part 20 is typically in the order of between 15 and 25 centimeters, while the body typically has a thickness in the order of 20 to 40 millimeters. It is however possible within the scope of the invention to envisage other dimensions, both larger and smaller, adapted to a specific field of application and the static and/or dynamic loads to be anticipated therein. A differently formed, for instance elongate, base part can also be applied instead of a circular or disc-like base part, in accordance with a specific requirement.

Figure 2B:
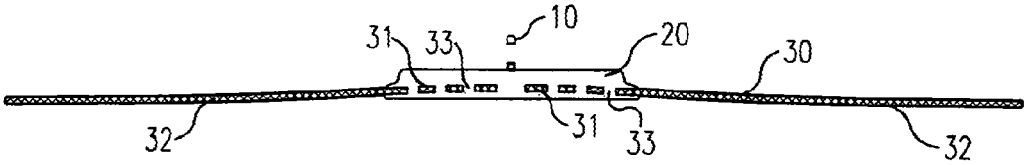
FIG. 2B shows a cross-section of the device of FIG. 1 along line B-B.

Extending from base part 20 is a flexible, i.e. limp flap 30, likewise having a circular outer periphery. A proximal part 31 of the flap protrudes here about 15 centimeters into base part 20, and a distal part 32 extends a distance of typically a minimum of about 20 to 30 centimeters away from the base part. Proximal part 31 has an open structure with openings 33, see FIG. 2B, for the purpose of receiving core material of body 20 therein while body 20 is being cast. The flap is thus integrated and anchored in the body in exceptionally durable, robust and leak-tight manner, while the free distal part 32 provides an adequate attachment basis for a surface attachment to an existing roof or wall-covering without having to adversely affect the integrity of this latter. With a view hereto, the flap is preferably formed from a piece of a usual wall-covering material, in particular a bituminous or plastic roof-covering material so that it can be firmly attached in conventional manner, such as glueing, burning or welding, to an existing, already present wall-covering. The open structure 33 of proximal part 31 of flexible flap 30 on the one hand provides a reliable and extremely strong anchoring of the flap in base part 20, but moreover allows casting material to flow through openings 33 from the one side of the flap to the other during the process of casting the body. Flap 30 can thus be already prearranged in the mould and the body as it were cast round the flap to form a fully integrated whole.

Figure 3:
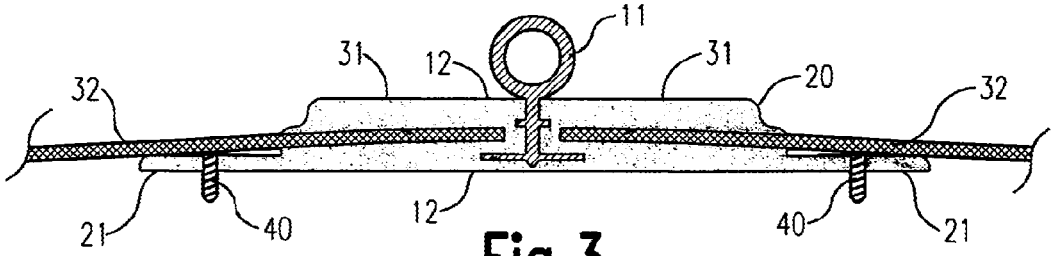
FIG. 3 shows a cross-section of a second exemplary embodiment of a mounting device according to the invention.

A second embodiment of the mounting device according to the invention is shown in FIG. 3. This embodiment is largely similar to the first, be it that in this case a flange part 21 radially extends laterally of base part 20 on an underside thereof. The flange part as separate element can herein be joined together with core part 20 or, as here, be cast as one monolithic whole together therewith. Flange part 21 extends through a distance of about 5 to 10 centimeters outside the part of base body 20 located on the other side of the flap and is provided with a number of drill holes for the purpose of mounting members 40 protruding therethrough, such as screws or bolts. On the thus provided mounting edge 21 the device can thus be principally fixed permanently to a surface by means of such mounting members 40, while the surface attachment, i.e. not penetrating into the object, of the flexible flap 32 lying thereover ensures the desired leak-tightness of the whole in the case of outside applications.

The mounting member comprises in this case a metal screw eyelet 11 which can be screwed later into body 20, optionally after a drill hole adapted thereto has been arranged, or as here has advantageously already been inserted into the mould during the process of casting the body in order to allow the material of the body to flow therearound and subsequently cure. If desired, one or more flanges or wings 12 can here be provided on a shank of mounting member 11 which later ensure an extremely rigid anchoring in body 20. This embodiment thus provides, even under extreme operational conditions, particularly in respect of ambient temperature and load, an exceptionally reliable mounting device which can be applied safely as base in a fall protection system under any conceivable practical conditions.

Figure 4:
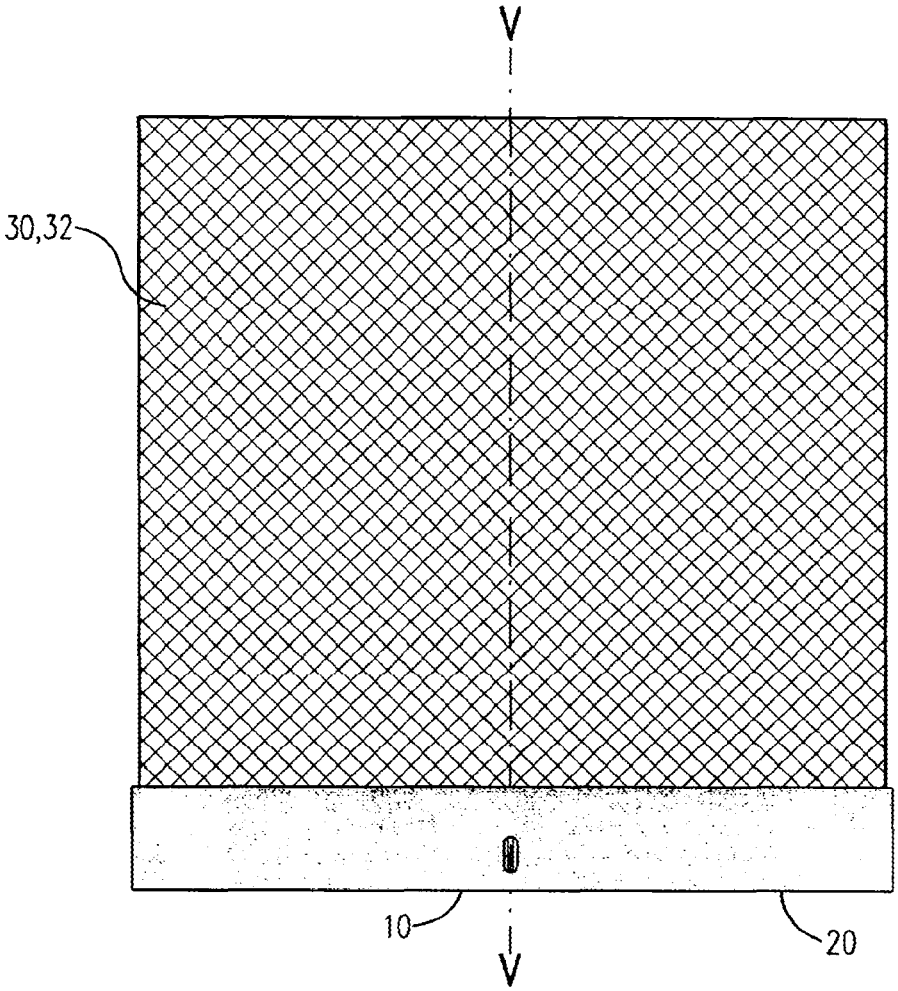
FIG. 4 shows a top view of a third exemplary embodiment of a mounting device according to the invention.
Figure 5:
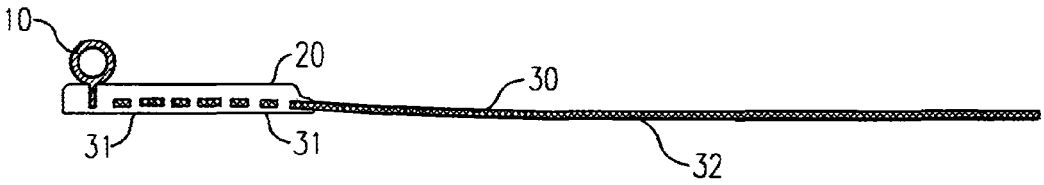
FIG. 5 shows a cross-section of the device of FIG. 4 along line V-V.

A third embodiment of a mounting device according to the invention is shown in FIGS. 4 and 5. In this case the device comprises an elongate base part 20 which, as in the foregoing examples, has been cast from a suitable plastic as core material around a proximal part 31 of a flexible flap 30 extending laterally therefrom. The shown device is particularly suitable as roof safety device, wherein the device is arranged, with base part 20 directed toward a roof edge, by attaching the free distal end 32 of the flexible flap to a roof surface. With a view to a monolithic, reliable connection, the flexible flap is here advantageously formed from a usual roof-covering material, such as a bitumen, EPDM or other plastic, and attached by glueing, welding or other adhesion to a similar existing roof-covering. Screwed into base part 20 is a metal fixing eyelet 10 to which a personal safety means of a fall protection system can be secured.

Although the invention has been further elucidated on the basis of only a pair of exemplary embodiments, it will be apparent that the invention is by no means limited thereto. On the contrary, many variations and embodiments are still possible for a person with ordinary skill in the art without he/she being required to depart from the scope of the invention. In the shown exemplary embodiments for example, the flexible flap comprises a central opening and an open structure, particularly for the purpose of allowing an adequate flow of material between separate mould parts during a manufacturing process and for achieving a reliable anchoring of the flap in the base part in the final product, although a flap with closed proximal part can also be applied if desired. In such a case material for the base part can advantageously be cast round the flap from both sides during manufacture in order to achieve an adequate mould filling and encapsulation, while a reinforced anchoring of the flap in the base body can be achieved, if desired, using through-pins or other anchoring members.

The base part of the device according to the invention can also comprise, in addition to the flexible flap, a flexible skirt thereunder of for instance a roof-covering material, a suitable plastic foil or a textile fabric. Such a skirt allows of permanent fixing to an existing roof-covering, for instance by stapling, nailing or sewing, while the flexible flap lying thereover ensures an effective water-tightness.

The stated materials and dimension are generally given mainly by way of illustration, although other materials, shapes and dimensions can in principle be adapted relatively freely to a specific application. In addition to a relatively compact circular base part, an elongate beam-like base part is for instance possible in this respect, from which a flexible flap extends laterally not only on one side as in the shown exemplary embodiment, but also on two sides. The flexible flap according to the invention is here also integrated substantially tightly into the base part.

The fixing member in the exemplary embodiments comprises a form-fitting, form-retaining eyelet protruding outside the other part of the base part, but can also be embodied in diverse other ways. A bowl, in which a mounting member is arranged recessed and covered, can thus be formed in the form-retaining body on a main surface thereof. The mounting member here advantageously comprises one or more rod-like metal parts which span such a dish transversely and an outer end of which protrudes a sufficient distance and sufficiently deeply on either side into the body in order to enable a reliable anchoring.

As well as by casting a thermoplastic material at increased temperature and physical curing thereof, the desired tight integration of the flap in the base part can also be realized by forming a starting material, optionally at increased pressure and/or temperature, round the proximal part of the flap and chemical curing thereof. Numerous materials are suitable for this purpose, such as in particular (epoxy) resins and rubbers.

Instead of a bituminous flexible flap, a flexible flap of another leak-tight material can also be applied, particularly of a leak-tight plastic foil of for instance polyvinyl chloride or EPDM. And instead of being formed as separate component which is assembled with another part of the device, the flexible flap can also be formed as one monolithic whole with an adjacent part of the base part, and then be manufactured wholly together therewith, for instance in a (thermo)forming process. In such a case the flexible flap can be durably adhered, for instance by glueing, to a surface, which can give an extremely strong connection up to exceptionally high ambient temperatures.

In respect of fields of application, the device according to the invention is not only suitable within the context of a fall protection system, but the device generally provides a fixing base for roof or wall constructions, such as particularly roof antennas and optionally temporary structures on a roof of a building. One or more threaded ends or screw bolts protruding out of the body can advantageously be applied here as mounting member instead of a fixing eyelet.

The invention claimed is:

1. Mounting device for mounting on an object, comprising a form-retaining base part with at least one mounting member and comprising a flexible flap which extends laterally relative to the base part with a free distal part, and which is intended and adapted to be attached to a surface of the object, wherein the base part comprises an integrally formed, form-retaining body with a solid core, and a proximal part of the flexible flap is incorporated tightly in the core of the body and the distal part of the flexible flap extends laterally from the base part.

2. Mounting device as claimed in claim 1, wherein the body comprises a core material which is cast around the proximal part of the flap.

3. Mounting device as claimed in claim 2, wherein the core material comprises a thermoplastic plastic and is arranged at increased temperature on either side of the proximal part of the flap in a thermoforming process.

4. Mounting device as claimed in claim 1, wherein the proximal part of the flap has an open structure for the purpose of receiving core material of the body between a first and second main surface of the flap.

5. Mounting device as claimed in claim 1, wherein the flap comprises a wall-covering material, in particular a bituminous or plastic roof-covering material.

6. Mounting device as claimed in claim 1, wherein the body and the flexible flap comprise substantially concentric or circular peripheries.

7. Mounting device as claimed in claim 6, wherein the body has a diameter lying between 15 and 25 centimeters and a substantially free distal part of the flap extends at least 20-30 centimeters outside the body.

8. Mounting device as claimed in claim 6, wherein the proximal part of the flap protrudes at least 10 centimeters into the body.

9. Mounting device as claimed in claim 1, wherein on a side of the flap remote from the mounting member a flange part extends laterally from the body with an outer edge lying between a corresponding outer edge of a part of the body lying on an opposite side of the flap and an outer edge of the flap.

10. Mounting device as claimed in claim 9, wherein the flange part extends as one whole from the body.

11. Mounting device as claimed in claim 1, wherein the mounting member forms one whole with the body.

12. Fall protection system, comprising at least one mounting device as claimed in claim 1 in a fall protection assembly which further comprises at least a personal fall protection means which is intended and adapted to be coupled directly or indirectly to a mounting member of the at least one mounting device.

* * * * *